US011408655B2

(12) United States Patent
Semura

(10) Patent No.: US 11,408,655 B2
(45) Date of Patent: Aug. 9, 2022

(54) OIL SEPARATOR, FILTER ELEMENT, AND COMPRESSOR FOR CRYOCOOLER

(71) Applicant: SUMITOMO HEAVY INDUSTRIES, LTD., Tokyo (JP)

(72) Inventor: Kenta Semura, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 230 days.

(21) Appl. No.: 16/808,398

(22) Filed: Mar. 4, 2020

(65) Prior Publication Data

US 2020/0284486 A1 Sep. 10, 2020

(30) Foreign Application Priority Data

Mar. 6, 2019 (JP) ..... JP2019-040474

(51) Int. Cl.
*F25B 43/02* (2006.01)
*F25B 9/14* (2006.01)
*F25B 43/00* (2006.01)

(52) U.S. Cl.
CPC ..... *F25B 43/02* (2013.01); *F25B 9/145* (2013.01); *F25B 43/003* (2013.01)

(58) Field of Classification Search
CPC ..... F25B 43/003; F25B 43/02
See application file for complete search history.

(56) References Cited

U.S. PATENT DOCUMENTS 4,008,154 A * 2/1977 Richards ..... B01D 11/0273 210/217
4,516,994 A * 5/1985 Kocher ..... B01D 45/12 210/304
5,605,748 A * 2/1997 Kennedy ..... B01D 39/1623 210/315
6,096,117 A * 8/2000 Lisson ..... B01D 39/12 95/273
8,709,117 B2 4/2014 Maruyama
10,464,005 B2 * 11/2019 Tanaka ..... B01D 46/2414
2012/0240537 A1 * 9/2012 Maruyama ..... F25B 43/02 55/476

FOREIGN PATENT DOCUMENTS

JP 4398959 B2 1/2010
JP 5367750 B2 12/2013
WO WO-0001461 A1 * 1/2000 ..... F04C 29/026

* cited by examiner

*Primary Examiner* — David J Teitelbaum
(74) *Attorney, Agent, or Firm* — HEA Law PLLC

(57) ABSTRACT

An oil separator includes: an oil separator container; and a filter element that is disposed in the oil separator container, defines an outer cavity between the oil separator container and itself, includes an inner cavity into which refrigerant gas is introduced, and separates oil from the refrigerant gas flowing to the outer cavity from the inner cavity. The filter element includes a tubular inner filter member that surrounds the inner cavity, and an outer filter layer that includes a refrigerant gas outlet surface exposed to the outer cavity and is disposed outside the inner filter member. A wire-like or band-like filter retaining member that is in contact with the outer filter layer from the outside may be provided. The refrigerant gas outlet surface may occupy at least 80% of the surface area of the outer filter layer.

9 Claims, 8 Drawing Sheets

20

OIL SEPARATOR, FILTER ELEMENT, AND COMPRESSOR FOR CRYOCOOLER

RELATED APPLICATIONS

The content of Japanese Patent Application No. 2019-040474, on the basis of which priority benefits are claimed in an accompanying application data sheet, is in its entirety incorporated herein by reference.

BACKGROUND

Technical Field

Certain embodiments of the present invention relate to an oil separator, a filter element, and a compressor for a cryocooler.

Description of Related Art

A compressor for refrigerant gas used in a cryocooler often includes an oil separator and an adsorber to remove oil from refrigerant gas which is compressed and of which pressure is raised. A little oil is mixed in the refrigerant gas flowing into the oil separator. Most of the oil is separated from the refrigerant gas by the oil separator, but a small amount of oil may flow out of the oil separator together with the refrigerant gas. This oil is adsorbed by the adsorber and is removed from the refrigerant gas.

SUMMARY

According to an aspect of the invention, there is provided an oil separator including: an oil separator container; and a filter element that is disposed in the oil separator container, defines an outer cavity between the oil separator container and itself, includes an inner cavity into which refrigerant gas is introduced, and separates oil from the refrigerant gas flowing to the outer cavity from the inner cavity. The filter element includes a tubular inner filter member that surrounds the inner cavity, an outer filter layer that includes a refrigerant gas outlet surface exposed to the outer cavity and is disposed outside the inner filter member, and a wire-like or band-like filter retaining member that is in contact with the outer filter layer from the outside.

According to another aspect of the invention, there is provided an oil separator including: an oil separator container; and a filter element that is disposed in the oil separator container, defines an outer cavity between the oil separator container and itself, includes an inner cavity into which refrigerant gas is introduced, and separates oil from the refrigerant gas flowing to the outer cavity from the inner cavity. The filter element includes a tubular inner filter member that surrounds the inner cavity and an outer filter layer that includes a refrigerant gas outlet surface exposed to the outer cavity and is disposed outside the inner filter member, and the refrigerant gas outlet surface occupies at least 80% of a surface area of the outer filter layer.

According to another aspect of the invention, there is provided a compressor for a cryocooler including any one of the above-mentioned oil separators.

According to another aspect of the invention, there is provided a filter element that separates oil from refrigerant gas flowing to an outer cavity from an inner cavity. The filter element includes a tubular inner filter member that surrounds the inner cavity, an outer filter layer that includes a refrigerant gas outlet surface exposed to the outer cavity and is disposed outside the inner filter member, and a wire-like or band-like filter retaining member that is in contact with the outer filter layer from the outside.

According to another aspect of the invention, there is provided a filter element that separates oil from refrigerant gas flowing to an outer cavity from an inner cavity. The filter element includes a tubular inner filter member that surrounds the inner cavity and an outer filter layer that includes a refrigerant gas outlet surface exposed to the outer cavity and is disposed outside the inner filter member, and the refrigerant gas outlet surface occupies at least 80% of a surface area of the outer filter layer.

Any combination of the above-mentioned components, and aspects in which the components or expressions of the invention are substituted with each other between a method, a device, a system, and the like are also effective as the aspects of the invention.

DETAILED DESCRIPTION

Figure 1:
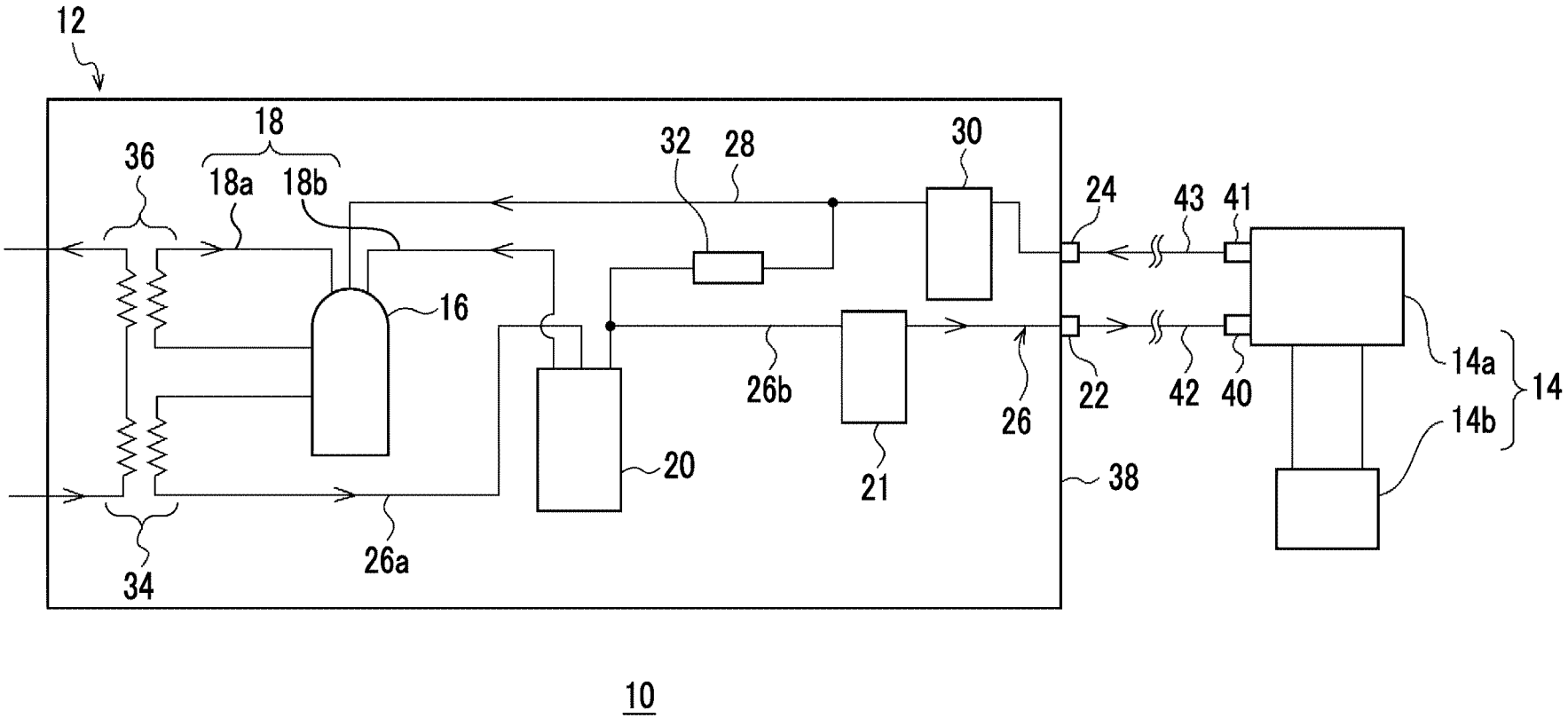
FIG. 1 is a diagram schematically showing a cryocooler according to an embodiment.

An increase in the outflow of oil from the oil separator is not desired. Since the adsorbent of the adsorber needs to be replaced early as the outflow of oil is increased, operating cost may be increased. In a case where a large adsorber on which a large amount of adsorbent is mounted is employed, the frequency of replacement of the adsorbent can be reduced but this causes an increase in the size of the compressor. In a case where the oil is not removed by the adsorber, the oil flows into an expander together with the refrigerant gas and may be solidified at a low-temperature part. This can cause the deterioration of the expander and a reduction in cooling capacity.

It is desirable to reduce the outflow of oil from an oil separator.

Embodiments of the invention will be described in detail below with reference to the drawings. The same or equivalent components, members, and processing in the description and the drawings are denoted by the same reference numerals and the repeated description thereof will be appropriately omitted. The scale and shape of each part to be shown are conveniently set to facilitate the description, and are not interpreted in a limited way as long as not particularly mentioned. The embodiments are exemplary and do not limit the scope of the invention at all. All features to be described in the embodiments and combinations thereof are not necessarily essential to the invention.

FIG. 1 is a diagram schematically showing a cryocooler according to an embodiment.

A cryocooler 10 includes a compressor 12 and a cold head 14. The compressor 12 is configured to collect the refrigerant gas of the cryocooler 10 from the cold head 14, to raise the pressure of the collected refrigerant gas, and to supply the refrigerant gas to the cold head 14 again. The compressor 12 is also referred to as a compressor unit. The cold head 14 is also referred to as an expander, and includes a room-temperature part 14*a* and a low-temperature part 14*b* also referred to as a cooling stage. The compressor 12 and the cold head 14 form the refrigeration cycle of the cryocooler 10, and the low-temperature part 14*b* is cooled to a desired cryogenic temperature by the refrigeration cycle. The refrigerant gas is also referred to as working gas and is usually helium gas, but any other suitable gas may be used.

The cryocooler 10 is, for example, a single-stage or two-stage Gifford-McMahon (GM) cryocooler, but may be a pulse tube cryocooler, a Sterling cryocooler, or another type of cryocooler. The cold head 14 has a different structure depending on the type of the cryocooler 10, but the compressor 12 can use a structure to be described below regardless of the type of the cryocooler 10.

In general, both the pressure of the refrigerant gas supplied to the cold head 14 from the compressor 12 and the pressure of the refrigerant gas collected to the compressor 12 from the cold head 14 are significantly higher than the atmospheric pressure, and can be referred to as first high pressure and second high pressure, respectively. For the convenience of description, the first high pressure and the second high pressure are also simply referred to as high pressure and low pressure, respectively. Typically, the high pressure is in the range of, for example, 2 to 3 MPa. The low pressure is in the range of, for example, 0.5 to 1.5 MPa and is, for example, about 0.8 MPa.

The compressor 12 includes a compressor body 16, an oil line 18, an oil separator 20, and an adsorber 21. Further, the compressor 12 includes a discharge port 22, a suction port 24, a discharge flow channel 26, a suction flow channel 28, a storage tank 30, a bypass valve 32, a refrigerant gas cooling unit 34, and an oil cooling unit 36.

The compressor body 16 is configured to compress the refrigerant gas, which is sucked from a suction port thereof, therein and to discharge the compressed refrigerant gas from a discharge port thereof. The compressor body 16 may be, for example, a scroll pump, a rotary pump, or another pump for pressurizing the refrigerant gas. The compressor body 16 may be configured to discharge the refrigerant gas of which the flow rate is fixed and constant. Alternatively, the compressor body 16 may be configured to make the flow rate of the refrigerant gas, which is to be discharged, variable. The compressor body 16 is sometimes referred to as a compression capsule.

Oil is used in the compressor body 16 for cooling and lubrication, and the sucked refrigerant gas is directly exposed to the oil in the compressor body 16. Accordingly, the refrigerant gas is delivered from the discharge port in a state where the oil is slightly mixed in the refrigerant gas.

The oil line 18 includes an oil circulation line 18*a* and an oil return line 18*b*. The oil circulation line 18*a* includes the oil cooling unit 36, and is configured so that oil flowing out of the compressor body 16 is cooled by the oil cooling unit 36 and flows into the compressor body 16 again. The oil circulation line 18*a* is provided with an orifice that controls the flow rate of the oil flowing in the oil circulation line 18*a*. Further, the oil circulation line 18*a* may be provided with a filter that removes dust contained in the oil. The oil return line 18*b* connects the oil separator 20 to the compressor body 16 to return the oil, which is collected by the oil separator 20, to the compressor body 16. A filter that removes dust contained in the oil and separated by the oil separator 20 and an orifice that controls the amount of oil to be returned to the compressor body 16 may be provided in the middle of the oil return line 18*b*.

The oil separator 20 is provided to separate oil, which is mixed in the refrigerant gas in a case where the refrigerant gas passes through the compressor body 16, from the refrigerant gas. The oil separator 20 is connected to the discharge port of the compressor body 16 through an upstream portion 26*a* of the discharge flow channel 26. Further, the oil separator 20 is connected to the discharge port 22 through a downstream portion 26*b* of the discharge flow channel 26. The details of the oil separator 20 will be described later.

The adsorber 21 is provided to remove, for example, vaporized oil and other contaminants, which remain in the refrigerant gas, from the refrigerant gas by adsorption. The adsorber 21 is disposed in the middle of the downstream portion 26*b* of the discharge flow channel 26.

The discharge port 22 is an outlet for refrigerant gas that is installed on a compressor casing 38 to deliver the refrigerant gas, of which pressure is raised up to high pressure by the compressor body 16, from the compressor 12, and the suction port 24 is an inlet for refrigerant gas that is installed on the compressor casing 38 to receive low-pressure refrigerant gas into the compressor 12. The respective components of the compressor 12, such as the compressor body 16 and the oil separator 20, are housed in the compressor casing 38. The discharge port of the compressor body 16 is connected to the discharge port 22 by the discharge flow channel 26, and the suction port 24 is connected to the suction port of the compressor body 16 by the suction flow channel 28.

The storage tank 30 is provided as a volume for removing pulsation that is included in low-pressure refrigerant gas returning to the compressor 12 from the cold head 14. The storage tank 30 is disposed on the suction flow channel 28.

The bypass valve 32 connects the discharge flow channel 26 to the suction flow channel 28 so as to bypass the compressor body 16. For example, the bypass valve 32 branches from the downstream portion 26*b* of the discharge flow channel 26 between the oil separator 20 and the adsorber 21, and is connected to the suction flow channel 28 between the compressor body 16 and the storage tank 30. The bypass valve 32 is provided to control the flow rate of the refrigerant gas and/or to equalize the pressure in the discharge flow channel 26 and the pressure in the suction flow channel 28 in a case where the compressor 12 is stopped.

The refrigerant gas cooling unit 34 and the oil cooling unit 36 form a cooling system that cools the compressor 12 using a cooling medium, such as cooling water. The refrigerant gas cooling unit 34 is disposed on the upstream portion 26*a* of the discharge flow channel 26 and is provided to cool the high-pressure refrigerant gas that is heated by compression heat generated with the compression of the refrigerant gas in the compressor body 16. The refrigerant gas cooling unit 34 cools the refrigerant gas by heat exchange between the refrigerant gas and the cooling medium. Further, the oil cooling unit 36 cools oil by heat exchange between the oil, which flows out of the compressor body 16, and the cooling medium. The cooling medium is supplied to the compressor 12 from the outside, and is discharged to the outside of the compressor 12 through the refrigerant gas cooling unit 34 and the oil cooling unit 36. In this way, the compression heat generated in the compressor body 16 is removed to the outside of the compressor 12 together with the cooling medium. The cooling medium may be cooled by, for example, a chiller (not shown) and supplied again.

Further, the cryocooler 10 includes a high pressure port 40 and a low pressure port 41 that are provided on the room-temperature part 14*a* of the cold head 14. The high pressure port 40 is connected to the discharge port 22 by a high-pressure pipe 42, and the low pressure port 41 is connected to the suction port 24 by a low-pressure pipe 43.

Accordingly, the refrigerant gas collected to the compressor 12 from the cold head 14 flows into the suction port 24 of the compressor 12 from the low pressure port 41 through the low-pressure pipe 43. The refrigerant gas is collected to the suction port of the compressor body 16 through the storage tank 30 disposed on the suction flow channel 28. The refrigerant gas is compressed and the pressure of the refrigerant gas is raised by the compressor body 16. The refrigerant gas delivered from the discharge port of the compressor body 16 exits the compressor 12 from the discharge port 22 through the refrigerant gas cooling unit 34, the oil separator 20, and the adsorber 21 disposed on the discharge flow channel 26. The refrigerant gas is supplied to the inside of the cold head 14 through the high-pressure pipe 42 and the high pressure port 40.

Figure 2:
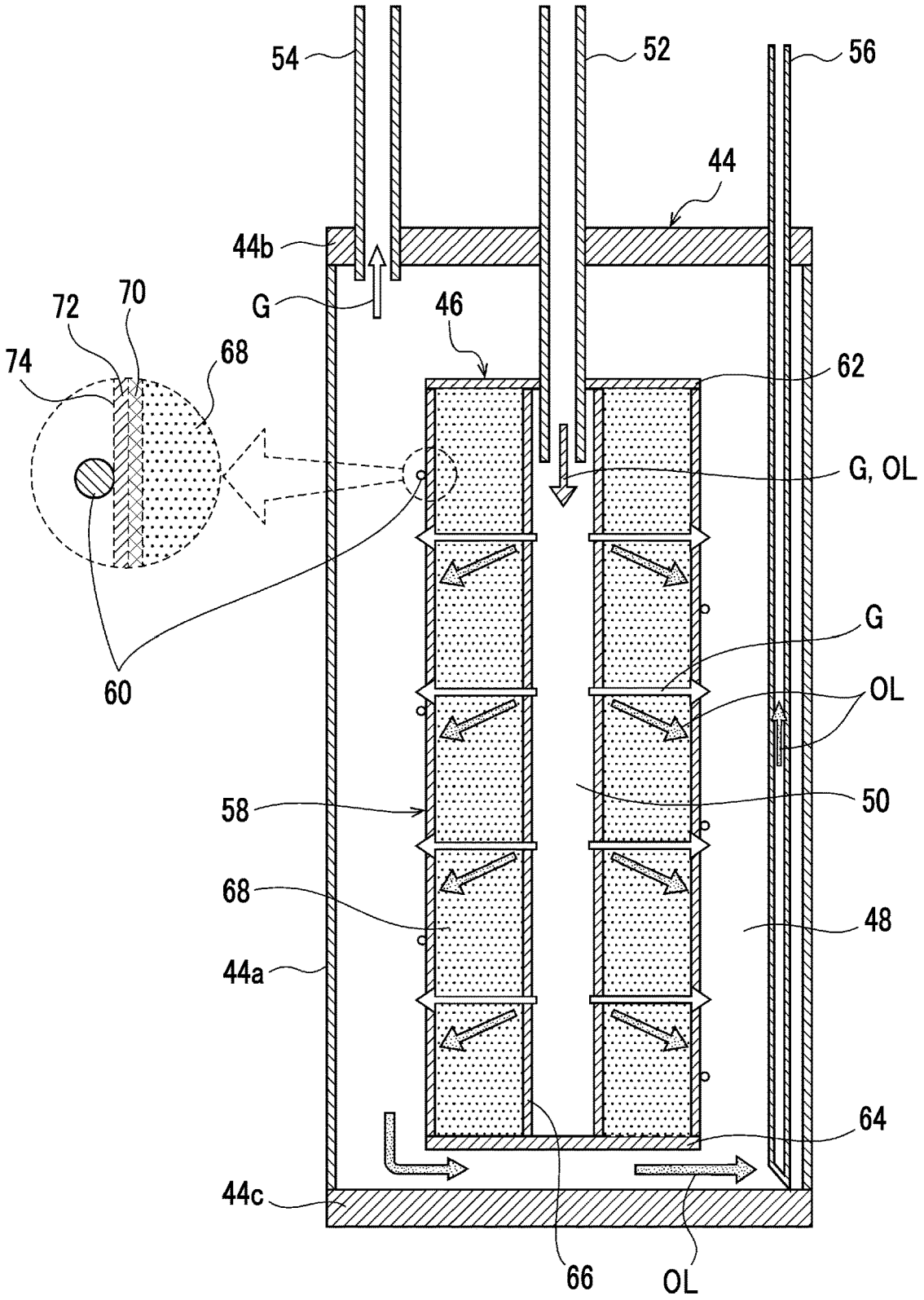
FIG. 2 is a cross-sectional view schematically showing an oil separator according to the embodiment.
Figure 3:
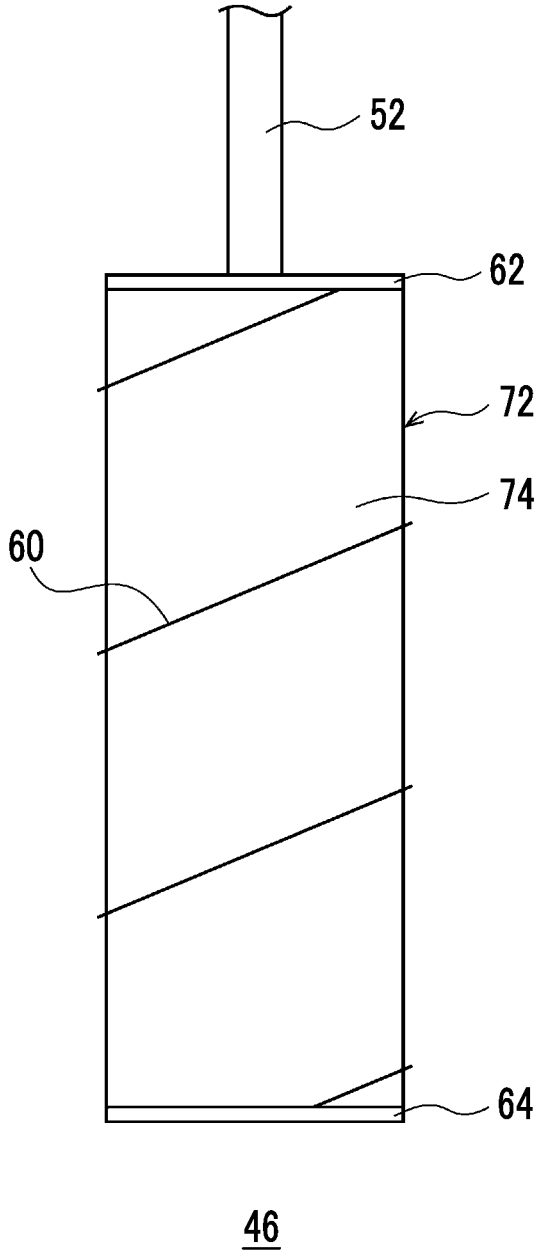
FIG. 3 is a side view schematically showing a filter element according to the embodiment.

FIG. 2 is a cross-sectional view schematically showing the oil separator according to the embodiment. FIG. 3 is a side view schematically showing a filter element according to the embodiment.

The oil separator 20 includes an oil separator container 44 and a filter element 46. The filter element 46 is disposed in the oil separator container 44 and defines an outer cavity 48 between the oil separator container 44 and itself. Further, the filter element 46 includes an inner cavity 50 into which the refrigerant gas is to be introduced, and separates oil from the refrigerant gas flowing to the outer cavity 48 from the inner cavity 50. In FIG. 2, for easy understanding, the flow of refrigerant gas in the oil separator 20 is indicated by white arrows G and the flow of oil is indicated by deep-color arrows OL.

The oil separator 20 is configured as a vertical oil separator. The oil separator 20 has the shape of an elongated tube, and is installed in the compressor 12 so that the longitudinal direction of the oil separator 20 coincides with a vertical direction. The refrigerant gas (in which some oil is mixed) to flow in from the compressor body 16 shown in FIG. 1 is introduced from the upper portion of the oil separator 20. The refrigerant gas purified by the filter element 46 is discharged to the outside of the oil separator 20 from the upper portion of the oil separator 20. The oil separated from the refrigerant gas by the filter element 46 flows down in the vertical direction along the inside or the surface of the filter element 46, and is collected from the bottom of the oil separator 20.

The oil separator container 44 is a cylindrical container that defines the outer shape of the oil separator 20, and includes a container tube portion 44*a*, an upper flange 44*b*, and a lower flange 44*c*. The upper flange 44*b* is fixed to the upper end of the container tube portion 44*a*, and the lower flange 44*c* is fixed to the lower end of the container tube portion 44*a*. Each of the upper flange 44*b* and the lower flange 44*c* is fixed to the container tube portion 44*a* by, for example, welding, so that the oil separator container 44 becomes a hermetic container.

The upper flange 44*b* is provided with a refrigerant gas introduction pipe 52, a refrigerant gas delivery pipe 54, and a return oil pipe 56. The refrigerant gas introduction pipe 52 corresponds to a portion where the upstream portion 26*a* of the discharge flow channel 26 shown in FIG. 1 is connected to the oil separator 20. The refrigerant gas delivery pipe 54 corresponds to a portion where the downstream portion 26*b* of the discharge flow channel 26 is connected to the oil separator 20. The return oil pipe 56 corresponds to a portion where the oil return line 18*b* of the oil line 18 is connected to the oil separator 20.

The refrigerant gas introduction pipe 52 is provided to penetrate the upper flange 44*b*. The refrigerant gas introduction pipe 52 extends along the center axis of the oil separator 20. The refrigerant gas introduction pipe 52 penetrating the upper flange 44*b* extends to the inner cavity 50 of the filter element 46. The refrigerant gas introduction pipe 52 is opened at the upper portion of the inner cavity 50 in the example shown in FIG. 2, but the refrigerant gas introduction pipe 52 may extend to the vicinity of the bottom of the inner cavity 50. The refrigerant gas is introduced into the inner cavity 50 of the filter element 46 from the outside of the oil separator 20 through the refrigerant gas introduction pipe 52.

The refrigerant gas delivery pipe 54 is provided to penetrate the upper flange 44*b*. The refrigerant gas delivery pipe 54 penetrating the upper flange 44*b* is opened in the outer cavity 48 near the upper flange 44*b*, for example, between the upper flange 44*b* and the filter element 46 in the axial direction of the oil separator 20. The refrigerant gas flowing to the outer cavity 48 from the inner cavity 50 through the filter element 46 is discharged to the outside of the oil separator 20 from the refrigerant gas delivery pipe 54.

The return oil pipe 56 is provided to penetrate the upper flange 44*b*. The return oil pipe 56 penetrating the upper flange 44*b* extends to the vicinity of the lower flange 44*c* along the container tube portion 44*a*. The return oil pipe 56 is opened in the outer cavity 48 near the lower flange 44*c*, for example, between the filter element 46 and the lower flange 44*c* in the axial direction of the oil separator 20. The oil separated from the refrigerant gas by the filter element 46 is discharged to the outside of the oil separator 20 from the return oil pipe 56.

The filter element 46 includes a filter laminate 58, a filter retaining member 60, an upper lid 62, and a lower lid 64. The filter laminate 58 includes an inner tubular member 66, an inner filter member 68, a filter holding member 70, and an outer filter layer 72. FIG. 2 shows a partially enlarged view of an outer portion of the filter laminate 58 in a broken-line circle together.

The filter laminate 58 is sandwiched between the upper lid 62 and the lower lid 64. Each of the upper lid 62 and the lower lid 64 is a disk-shaped member made of metal, such as stainless steel. As described above, the refrigerant gas introduction pipe 52 penetrates the upper flange 44*b* and is inserted into the outer cavity 48. The refrigerant gas introduction pipe 52 further penetrates the upper lid 62 and extends into the inner cavity 50.

The upper lid 62 and the lower lid 64 are bonded to the upper and lower portions of the filter laminate 58 by, for example, an adhesive, respectively. The adhesive may be a sealable adhesive, such as an epoxy adhesive or a silicone adhesive. Accordingly, it is possible to prevent the formation of gaps between the filter laminate 58 and the upper lid 62 and between the filter laminate 58 and the lower lid 64. It is possible to prevent the refrigerant gas, which is introduced into the inner cavity 50 from the refrigerant gas introduction pipe 52, from flowing out to the outer cavity 48 through the gaps in a state where the refrigerant gas contains oil. Further, it is possible to prevent the oil, which is separated from the refrigerant gas and liquefied, from flowing out to the outer cavity 48 through the gaps.

The inner tubular member 66 is a tubular (for example, cylindrical) member formed using a punched plate made of, for example, stainless steel or carbon steel. The inner tubular member 66 is disposed coaxially with the center axis of the oil separator 20 so as to surround the refrigerant gas introduction pipe 52. The inner tubular member 66 is provided to support the inner filter member 68 from the inside. The inner space of the inner tubular member 66 is the inner cavity 50, and the inner cavity 50 is surrounded by the inner tubular member 66, the upper lid 62, and the lower lid 64. It is not essential that the inner tubular member 66 is a perforated plate, and any structure, such as a wire mesh, a plate provided with slits, or a member in which rods are disposed in the form of a grid, may be used as the inner tubular member 66 as long as the inner tubular member 66 supports the inner filter member 68 without obstructing the flow of gas.

The inner filter member 68 has a tubular shape and surrounds the inner cavity 50. The inner filter member 68 is also disposed coaxially with the center axis of the oil separator 20. The inner filter member 68 is provided around the inner tubular member 66 serving as a core so that a filter material is wound into a cylindrical shape. The inner filter member 68 occupies most of the volume of the filter laminate 58. The inner filter member 68 is formed of mineral fibers, such as glass wool, or other filter materials.

The filter holding member 70 is disposed between the inner filter member 68 and the outer filter layer 72. The filter holding member 70 is, for example, a wire mesh or other mesh members, and retains the outermost layer of the inner filter member 68 from the outside and holds the inner filter member 68. The filter holding member 70 reinforces the inner filter member 68 from the outside, and the inner tubular member 66 reinforces the inner filter member 68 from the inside. It is not essential that the filter holding member 70 is a wire mesh, and any structure, such as a perforated plate such as a punched metal, a plate provided with slits, or a member in which rods are disposed in the form of a grid, may be used as the filter holding member 70 as long as the filter holding member 70 supports the inner filter member 68 without obstructing the flow of gas.

The outer filter layer 72 has a refrigerant gas outlet surface 74 exposed to the outer cavity 48 and is disposed outside the inner filter member 68. Further, the outer filter layer 72 is disposed outside the filter holding member 70. For this reason, the inner filter member 68 and the filter holding member 70 are covered (or wrapped) with the outer filter layer 72, and are not exposed to the outer cavity 48. The refrigerant gas outlet surface 74 occupies at least a part (for example, most) of the outer surface of the outer filter layer 72. The outer cavity 48 is adjacent to the just outside of the outer filter layer 72.

The outer filter layer 72 is, for example, a nonwoven fabric. The nonwoven fabric includes a large number of pores, and has gas permeability for the refrigerant gas and permeability for oil. In a case where liquid oil separated by the inner filter member 68 flows down in the vertical direction along the outermost layer of the inner filter member 68 and the filter holding member 70, the oil can flow along the inner surface of the outer filter layer 72 or in the outer filter layer 72. In a case where the outer filter layer 72 is not provided, the oil is scattered and mixed in the refrigerant gas again by the refrigerant gas blown out through the inner filter member 68. The outer filter layer 72 can suppress the re-scattering of the oil and the re-mixing of the oil in the refrigerant gas.

The outer filter layer 72 may be a porous film made of, for example, a synthetic resin that has gas permeability for the refrigerant gas and permeability for oil. The porous film may be a film or sheet made of a porous material. Even in this case, the outer filter layer 72 can suppress the re-scattering of the oil and the re-mixing of the oil in the refrigerant gas that are caused by the flow of the refrigerant gas.

However, the outer filter layer 72 is not a perforated plate, such as a punched metal, as described later. In the filter element 46, a perforated plate can be disposed inside the outer filter layer 72 like the inner tubular member 66. However, a perforated plate is not disposed outside the outer filter layer 72.

The filter retaining member 60 is a wire-like member that is in contact with the outer filter layer 72 from the outside. The filter retaining member 60 retains the outer filter layer 72 from outside and holds the outer filter layer 72. One end of the filter retaining member 60 is connected to the upper lid 62, and the other end thereof is connected to the lower lid 64.

The filter retaining member 60 is formed of, for example, a piano wire or a metal wire. Alternatively, the filter retaining member 60 is not limited to a member made of metal. The filter retaining member 60 may be made of, for example, a synthetic resin or other fiber materials that can absorb oil.

The filter retaining member 60 has a helical shape. The filter retaining member 60 extends from the upper lid 62 to the lower lid 64 in a helical shape along the outer surface of the outer filter layer 72, and is wound around the outer filter layer 72. Accordingly, the filter retaining member 60 extends obliquely on the outer surface of the outer filter layer 72. Even though oil adheres to the filter retaining member 60, the oil is likely to flow down along the filter retaining member 60. Since the accumulation of oil on the filter retaining member 60 is suppressed, the re-scattering of the oil and the re-mixing of the oil in the refrigerant gas, which are caused by the flow of the refrigerant gas blown out of the outer filter layer 72, can be suppressed.

For example, the number of turns of the helical filter retaining member 60 per unit length (for example, 100 mm) of the filter element 46 in a longitudinal direction may be 5 (for example, 1 to 3) at most.

In this case, the surface area of a portion of the outer filter layer 72 covered with the filter retaining member 60 is sufficiently reduced (that is, the area of the refrigerant gas outlet surface 74 is sufficiently increased). In a case where a perforated plate including a large number of small holes like a punched metal is installed in the filter element 46 instead of the outer filter layer 72 or is additionally installed outside the outer filter layer 72, the speed of flow of the refrigerant gas at those small holes can be increased. In a case where oil adheres to the plate thickness portions of the lower edges of the small holes, the refrigerant gas of which the speed of flow is increased can scatter the oil. The scattered oil can be mixed in the refrigerant gas again. However, according to the embodiment, since the area of the refrigerant gas outlet surface 74 is sufficiently large, it is difficult for the speed of flow of the refrigerant gas to be locally increased and the re-scattering of the oil and the re-mixing of the oil in the refrigerant gas can be suppressed. Further, since the area through which the refrigerant gas can pass is increased, a pressure loss generated in the refrigerant gas is reduced.

The helix angle of the filter retaining member 60 (for example, the angle of the filter retaining member 60 with respect to a horizontal plane, that is, a plane perpendicular to the center axis of the oil separator 20) can be appropriately selected. Since the number of turns of the helix is increased in a case where the helix angle is small (in a case where the helix angle is smaller than, for example, 45°), the filter retaining member 60 can be tightly wound around the outer filter layer 72 and hold the outer filter layer 72. Since the number of turns of the helix is reduced in a case where the helix angle is large (in a case where the helix angle is larger than, for example, 45°), the area of the refrigerant gas outlet surface 74 can be increased. In this case, a plurality of (for example, two to three) filter retaining members 60 may be disposed at regular intervals in the circumferential direction to more reliably hold the outer filter layer 72.

The refrigerant gas outlet surface 74 of the outer filter layer 72 corresponds to a region, which is not covered with the filter retaining member 60, of the outer surface of the outer filter layer 72 (that is, a cylindrical surface between the upper lid 62 and the lower lid 64). The refrigerant gas outlet surface 74 occupies most of, for example, at least 80%, at least 85%, at least 90%, at least 95%, or at least 98% of the surface area of the outer filter layer 72. In other words, the filter retaining member 60 covers, for example, 20%, 15%, 10%, 5%, or 2% of the surface area of the outer filter layer 72 at most.

In this case, the outer filter layer 72 can suppress the re-scattering of the oil and the re-mixing of the oil in the refrigerant gas that are caused by the flow of the refrigerant gas. Further, since the area through which the refrigerant gas can pass is increased, a pressure loss generated in the refrigerant gas is reduced. In general, the porosity of a typical punched metal is up to about 75%. Accordingly, the ratio of the refrigerant gas outlet surface 74 to the surface area of the outer filter layer 72 may be larger than 75%.

Further, the ratio of the refrigerant gas outlet surface 74 to the surface area of the outer filter layer 72 may be, for example, less than 100%, less than 99.5%, less than 99%, less than 98.5%, or less than 98%. For example, in a case where an easily available wire is used as the filter retaining member 60, the refrigerant gas outlet surface 74 occupies, for example, 99.2% to 98% of the surface area of the outer filter layer 72. Furthermore, in a case where a piano wire having a diameter of 0.1 mm is used as the filter retaining member 60, the refrigerant gas outlet surface 74 occupies, for example, about 99.99% of the surface area of the outer filter layer 72. In other words, a ratio of the area covered with the filter retaining member 60 to the surface area of the outer filter layer 72 may be, for example, 2%, 1.5%, 1%, 0.5%, or 0.01% at most.

According to the configuration described above, the refrigerant gas containing oil is introduced into the inner cavity 50 of the oil separator 20 through the refrigerant gas introduction pipe 52. The refrigerant gas flows radially outward from the inner cavity 50 through the filter laminate 58 of the filter element 46 in the order of the inner tubular member 66, the inner filter member 68, the filter holding member 70, and the outer filter layer 72. When the refrigerant gas passes through the filter laminate 58, the oil contained in the refrigerant gas is separated from the refrigerant gas by being filtered out, and the refrigerant gas from which the oil has been separated flows into the outer cavity 48 from the refrigerant gas outlet surface 74. Then, the refrigerant gas introduced into the outer cavity 48 is discharged from the oil separator 20 through the refrigerant gas delivery pipe 54. The oil is discharged from the oil separator 20 through the return oil pipe 56.

According to the embodiment, most of the area of the outer filter layer 72 is opened to the outer cavity 48 as the refrigerant gas outlet surface 74. Accordingly, it is possible to suppress the re-scattering of the oil and the re-mixing of the oil in the refrigerant gas that are caused by the refrigerant gas blown to the outer cavity 48 from the outer filter layer 72. Therefore, the outflow of the oil from the oil separator 20 is reduced.

Since the amount of oil flowing into the adsorber 21 is reduced, the life of the adsorbent of the adsorber 21 can be extended. Accordingly, the frequency of replacement of the adsorbent can be reduced, so that the operating cost of the compressor 12 can be reduced. Alternatively, since the amount of the adsorbent to be mounted on the adsorber 21 can be reduced, the size of the adsorber 21, eventually, the size of the compressor 12 can be reduced. Since the amount of oil flowing out of the compressor 12 together with the refrigerant gas can be reduced, the deterioration of the cold head 14 and a reduction in cooling capacity caused by the oil are also suppressed.

FIGS. 4 to 8 show various other examples of the filter retaining member according to the embodiment. The filter retaining member 60 can have various shapes. FIGS. 4 to 8 schematically show the side views of the filter element 46 as with FIG. 3. The configuration of various examples of the filter retaining member according to the embodiment different from that of the above-described embodiment will be mainly described below, and common configuration will be briefly described or the description thereof will be omitted.

Figure 4:
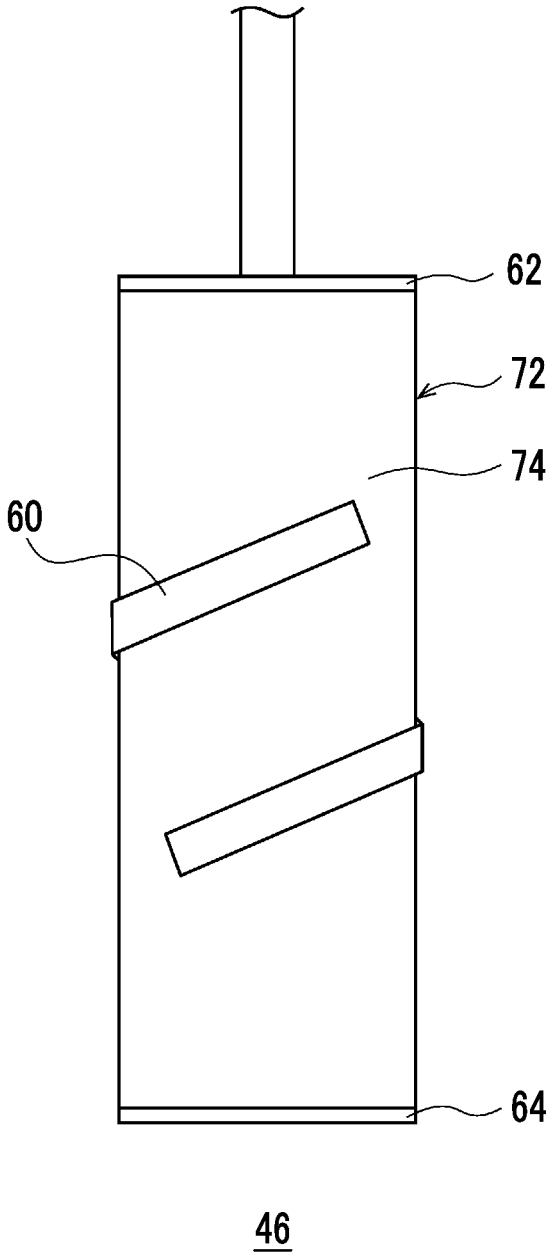
FIG. 4 shows an example of a filter retaining member according to the embodiment.

As shown in FIG. 4, the filter retaining member 60 may be a band-like member that is in contact with the outer filter layer 72 from the outside. The refrigerant gas outlet surface 74 may occupy at least 80% of the surface area of the outer filter layer 72. The filter retaining member 60 has a helical shape and is wound around the outer filter layer 72. However, the filter retaining member 60 may not be connected to the upper lid 62 and the lower lid 64.

Figure 5:
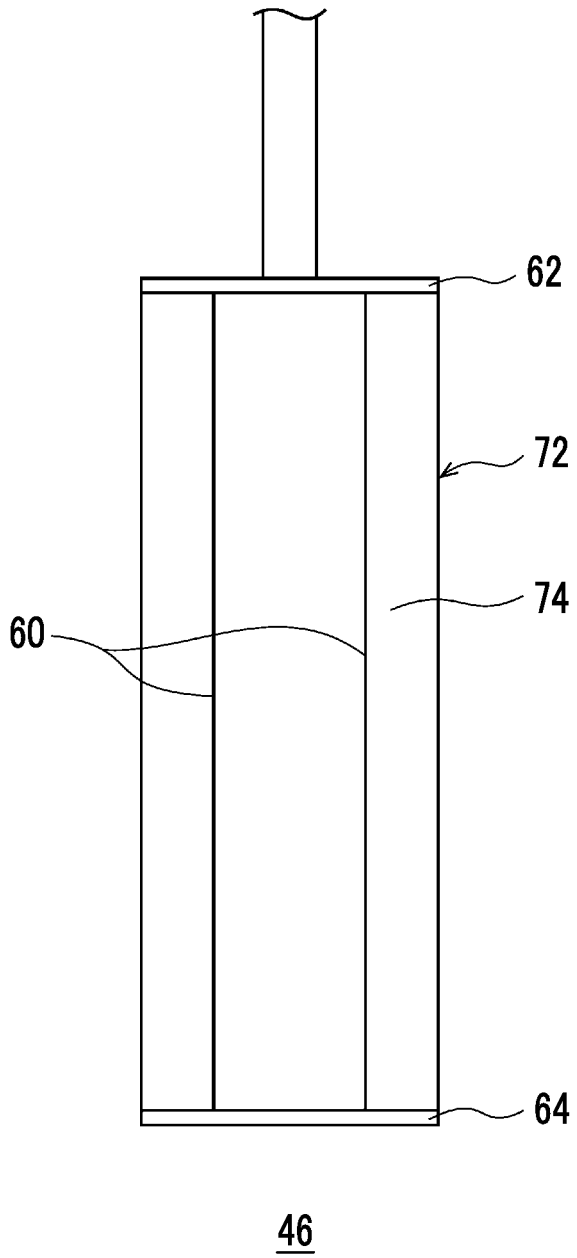
FIG. 5 shows an example of the filter retaining member according to the embodiment.

As shown in FIG. 5, the filter retaining member 60 may be a plurality of (for example, two to four) wire-like members extending in the vertical direction, that is, in the axial direction of the filter element 46. The filter retaining member 60 is in contact with the outer filter layer 72 from the outside. The refrigerant gas outlet surface 74 may occupy at least 80% of the surface area of the outer filter layer 72. For example, the plurality of wire-like members may be disposed at regular intervals in the circumferential direction and each of the wire-like members may be connected to the upper lid 62 and the lower lid 64.

Figure 6:
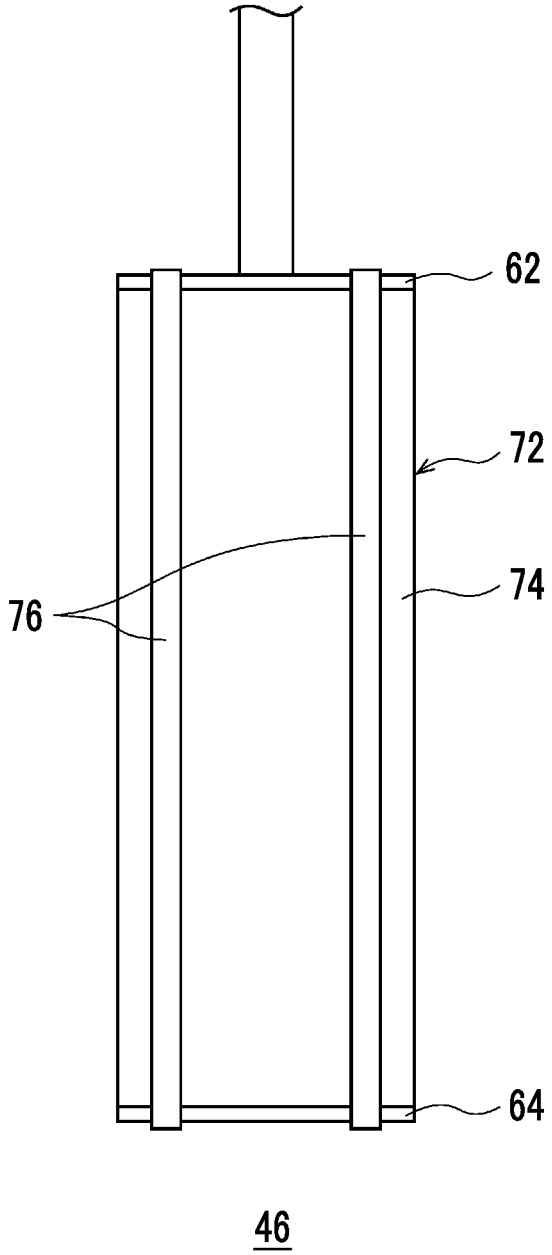
FIG. 6 shows an example of the filter retaining member according to the embodiment.

As shown in FIG. 6, the filter element 46 may include a plurality of lid connecting members 76. The lid connecting members 76 firmly couple the upper lid 62 to the lower lid 64 to reinforce the structure of the filter element 46. The lid connecting member 76 may be a rod-shaped member made of metal, such as stainless steel. The lid connecting members 76 extend in the vertical direction, and are disposed at regular intervals in the circumferential direction. The lid connecting members 76 are used as the filter retaining member. The inner surfaces of the lid connecting members 76 are pressed against the outer surface of the outer filter layer 72, so that the outer filter layer 72 is held. The refrigerant gas outlet surface 74 may occupy at least 80% of the surface area of the outer filter layer 72.

Figure 7:
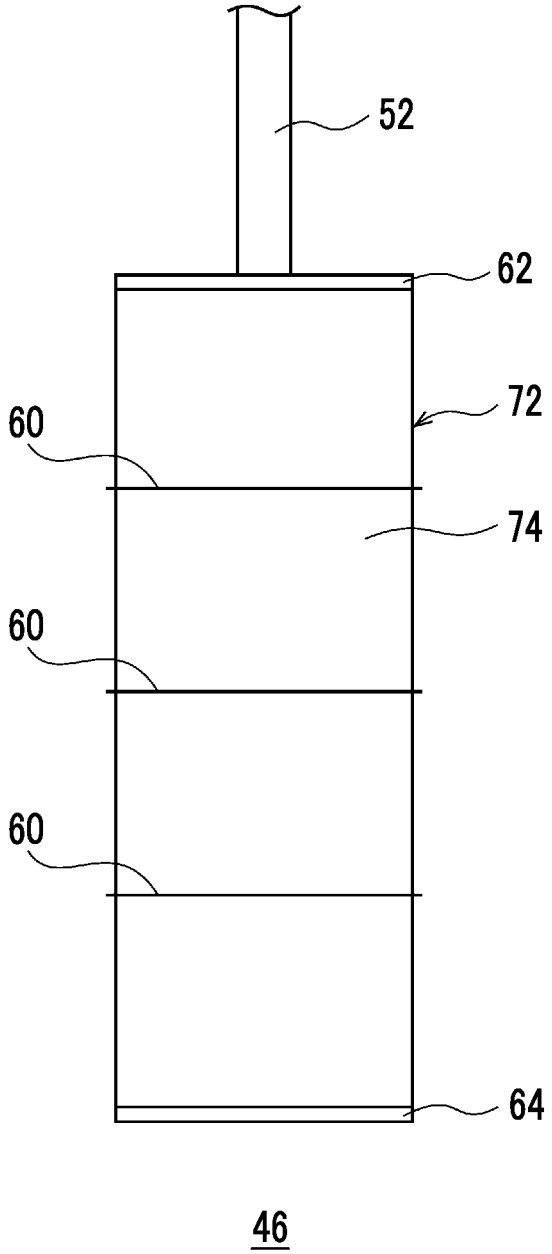
FIG. 7 shows an example of the filter retaining member according to the embodiment.

As shown in FIG. 7, the filter element 46 may include at least one ring-shaped filter retaining member 60. The refrigerant gas outlet surface 74 may occupy at least 80% of the surface area of the outer filter layer 72. For example, the filter retaining members 60 are disposed along a horizontal plane, that is, a plane perpendicular to the center axis of the filter element 46, and are wound around the outer filter layer 72. Accordingly, the filter retaining members 60 are not connected to the upper lid 62 and the lower lid 64. As shown in FIG. 7, a plurality of filter retaining members 60 may be provided. The filter retaining members 60 may be disposed along a plane inclined with respect to the horizontal plane, and may be wound around the outer filter layer 72.

Figure 8:
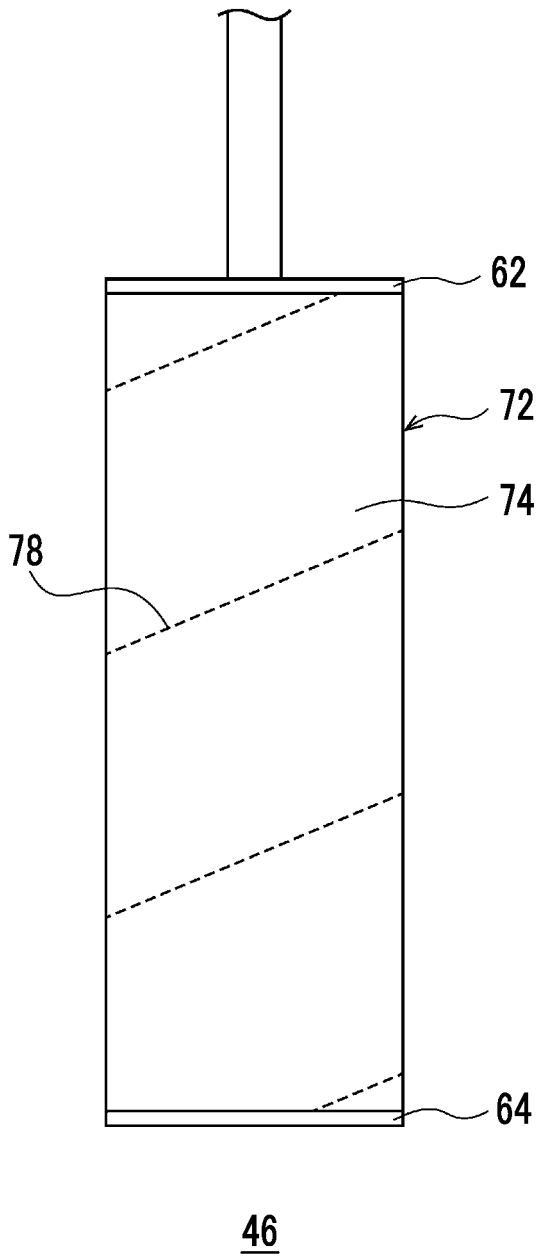
FIG. 8 shows an example of the filter retaining member according to the embodiment.

As shown in FIG. 8, the filter element 46 may not include the filter retaining member 60. The outer filter layer 72 is bonded to the filter holding member 70 and/or the inner filter member 68 by an adhesive 78. Accordingly, the adhesive 78 bonds the inner surface of the outer filter layer 72 to the filter holding member 70 and/or the inner filter member 68. For this reason, the entire outer surface (100%) of the outer filter layer 72 is exposed to the outer cavity 48 as the refrigerant gas outlet surface 74. For example, the adhesive 78 may be provided in a helical shape. Alternatively, the adhesive 78 may have a dot pattern.

It should be understood that the invention is not limited to the above-described embodiment, but may be modified into various forms on the basis of the spirit of the invention. Additionally, the modifications are included in the scope of the invention.

What is claimed is:

1. An oil separator comprising:

an oil separator container; and a filter element that is disposed in the oil separator container and which defines an outer cavity between the oil separator container and the filter element, wherein the filter element includes an inner cavity into which refrigerant gas is introduced and which separates oil from the refrigerant gas flowing from the inner cavity to the outer cavity, wherein the filter element includes:

a tubular inner filter member that surrounds the inner cavity, an outer filter layer that includes a refrigerant gas outlet surface exposed to the outer cavity, the outer filter layer arranged separate from the inner filter member and disposed outside the inner filter member, and a wire or band filter retaining member that is in contact with the outer filter layer from the outside, wherein the filter element comprises a filter holding member disposed between the inner filter member and the outer filter layer to separate the outer filter layer from the inner filter member.

2. The oil separator according to claim 1, wherein the filter retaining member has a helical shape.

3. The oil separator according to claim 1, wherein the refrigerant gas outlet surface occupies at least 80% of a surface area of the outer filter layer.

4. The oil separator according to claim 1, wherein the refrigerant gas outlet surface occupies at least 95% of a surface area of the outer filter layer.

5. The oil separator according to claim 1, wherein the outer filter layer is a nonwoven fabric or a porous film.

6. The oil separator according to claim 1, further comprising:

a filter holding member that is disposed between the inner filter member and the outer filter layer.

7. A compressor for a cryocooler comprising:

the oil separator according to claim 1.

8. An oil separator comprising:

an oil separator container; and a filter element that is disposed in the oil separator container and which defines an outer cavity between the oil separator container and the filter element, wherein the filter element includes an inner cavity into which refrigerant gas is introduced and which separates oil from the refrigerant gas flowing from the inner cavity to the outer cavity, wherein the filter element includes a tubular inner filter member that surrounds the inner cavity, and an outer filter layer that includes a refrigerant gas outlet surface exposed to the outer cavity, the outer filter layer arranged separate from the inner filter member and disposed outside the inner filter member, and the refrigerant gas outlet surface occupies at least 80% of a surface area of the outer filter layer, wherein the filter element comprises a filter holding member disposed between the inner filter member and the outer filter layer to separate the outer filter layer from the inner filter member.

9. A filter element that separates oil from refrigerant gas flowing to an outer cavity from an inner cavity, the filter element comprising:

a tubular inner filter member that surrounds the inner cavity;

an outer filter layer that includes a refrigerant gas outlet surface exposed to the outer cavity, the outer filter layer arranged separate from the inner filter member and disposed outside the inner filter member; and a wire or band filter retaining member that is in contact with the outer filter layer from the outside, wherein the filter element comprises a filter holding member disposed between the inner filter member and the outer filter layer to separate the outer filter layer from the inner filter member.

* * * * *